US006338884B1

(12) United States Patent
Chang

(10) Patent No.: US 6,338,884 B1
(45) Date of Patent: Jan. 15, 2002

(54) ANIMATED ORNAMENT

(76) Inventor: Chin-Sung Chang, No. 25, Lane 46, Chien Sui St., Shu Lin, Taipei Hsien (TW)

( * ) Notice: Subject to any disclaimer, the term of this patent is extended or adjusted under 35 U.S.C. 154(b) by 0 days.

(21) Appl. No.: 09/756,110

(22) Filed: Jan. 9, 2001

(51) Int. Cl.[7] ..... A47G 1/12

(52) U.S. Cl. ..... 428/13; 428/11; 428/14; 428/34.1; 428/66.5; 428/76; 428/542.2; 446/133; 446/236; 446/267; 40/406; 40/409; 40/411; 40/426; 40/430

(58) Field of Search ..... 428/13, 68, 76, 428/14, 66.5, 34.1, 542.2, 11; 40/430, 426, 411, 406, 409; 446/267, 236, 133

(56) References Cited

U.S. PATENT DOCUMENTS 6,052,930 A * 4/2000 Hermanson et al. ..... 40/410

* cited by examiner

*Primary Examiner*—Deborah Jones
*Assistant Examiner*—Abraham Bahta
(74) *Attorney, Agent, or Firm*—Jacobson Holman, PLLC

(57) ABSTRACT

An enhanced structure of an animated ornament composed of a globular shell, a hollow ball, a piece of non-magnetic, high-density material (such as copper, tin, plastic etc.), an inner magnet and an outer magnet. The hollow ball, having decorative figures, is smaller than the globular shell and is included in the globular shell. The space in between the globular shell and the hollow ball is filled up with liquid so that the hollow ball floats in the liquid and, when being shaken, turns around in all directions. Inside the lower part of the hollow ball attached a piece of non-magnetic, high-density material, such as plastic, copper and tin, and an inner magnet is fixed on the top of the non-magnetic material. An outer magnet is fastened onto the surface of the globular shell where the inner magnet and the outer magnet can line up in the same radius with the effect of magnetic attraction and thus result in the decorative figures on the hollow ball facing towards a fixed direction to achieve a desirable decoration effect.

2 Claims, 5 Drawing Sheets

ANIMATED ORNAMENT

BACKGROUND OF THE INVENTION

I. Field of the Invention

This invention relates generally to an enhanced structure of an animated ornament and, more specifically, to a globular shell filled with liquid, in which a hollow ball floats and turns around in all directions. The innovative design of the present invention features a piece of non-magnetic, high-density material and an inner magnet attached to the lower part inside the hollow ball, as well as an outer magnet fastened onto the surface of the globular shell. The inner magnet and the outer magnet can line up in the same radius when the structure is placed still, resulting in the decorative figures on the hollow ball facing towards a fixed direction (typically towards the front).

II. Description of the Prior Art

Heretofore, it is known to construct an ornamental product with animated features in an attempt to increase the variability of the ornament and to boost consumers' intent for purchase. An animated ornament of this kind typically employs the function of a compass to achieve the effect of animation. For instance, when a doll is printed on a backpack, the eyeballs of the doll can turn around inside the eye sockets. Nonetheless, a conventional animated ornament employs only two-dimensional decorative figures, which are lack of innovation and do not appeal to consumers.

It is also known to construct an animated ornament by making the decorative figures face only upwards. The design of this kind of animated ornament cannot set the decorative figures to face laterally and thus severely limits its applications.

Further, for ornamental products with a shape of animals or human beings, it is also known to construct eyeballs by having a pair of hollow balls floating inside a pair of globular sockets so that each of the hollow balls can turn around freely within each globular socket. Nonetheless, without specific control of the hollow balls, they can turn around in all directions when being shaken, resulting in the eyeballs facing inwards or towards other directions that gives the ornament a weird look.

The present invention improves on the heretofore known animated ornaments by providing three-dimensional decorative figures that are able to face towards lateral directions, especially towards the front. For ornamental products with a shape of animals or human beings, the eyeballs are constructed to turn around freely in all directions when being shaken, while the "eyes" would always look towards the front when the ornament is set still.

SUMMARY OF THE INVENTION

It is therefore a primary object of the present invention to provide an enhanced structure of an animated ornament comprising a globular shell filled with liquid in which a hollow ball floats and turns around freely in all directions when being shaken but points toward a fixed direction when the ornament is set still.

To achieve the object, the present invention improves the conventional structure of animated ornaments by providing a hollow ball floating in liquid filling inside a globular shell. The hollow ball is smaller than the globular shell and thus can be included in the globular shell. A piece of non-magnetic, high-density material (such as copper, tin, plastic etc.) is fastened inside the hollow ball, and an inner magnet is attached to the top of this non-magnetic material. On the surface of the globular shell fixed an outer magnet, where the inner magnet and the outer magnet can line up in the same radius with the effect of magnetic attraction, thus resulting in the decorative figures on the hollow ball facing towards the front.

Another quality that it is desired to simulate is to fill liquid in between the globular shell and the hollow ball so that that hollow ball floats in the liquid. The non-magnetic, high-density material keeps the hollow ball stable vertically, and the magnetic force between the inner magnet and the outer magnet keeps the hollow ball stable horizontally. Therefore, although the hollow ball turns around in all directions when the ornament is shaken, the decorative figures (such as a pair of eyeballs) would always point to a fixed direction (usually towards the front) when the ornament is set still.

BRIEF DESCRIPTION OF THE DRAWINGS

The accomplishment of the above-mentioned object of the present invention will become apparent from the following description and its accompanying drawings which disclose illustrative an embodiment of the present invention, and are as follows.

DESCRIPTION OF THE PREFERRED EMBODIMENT

Figure 1:
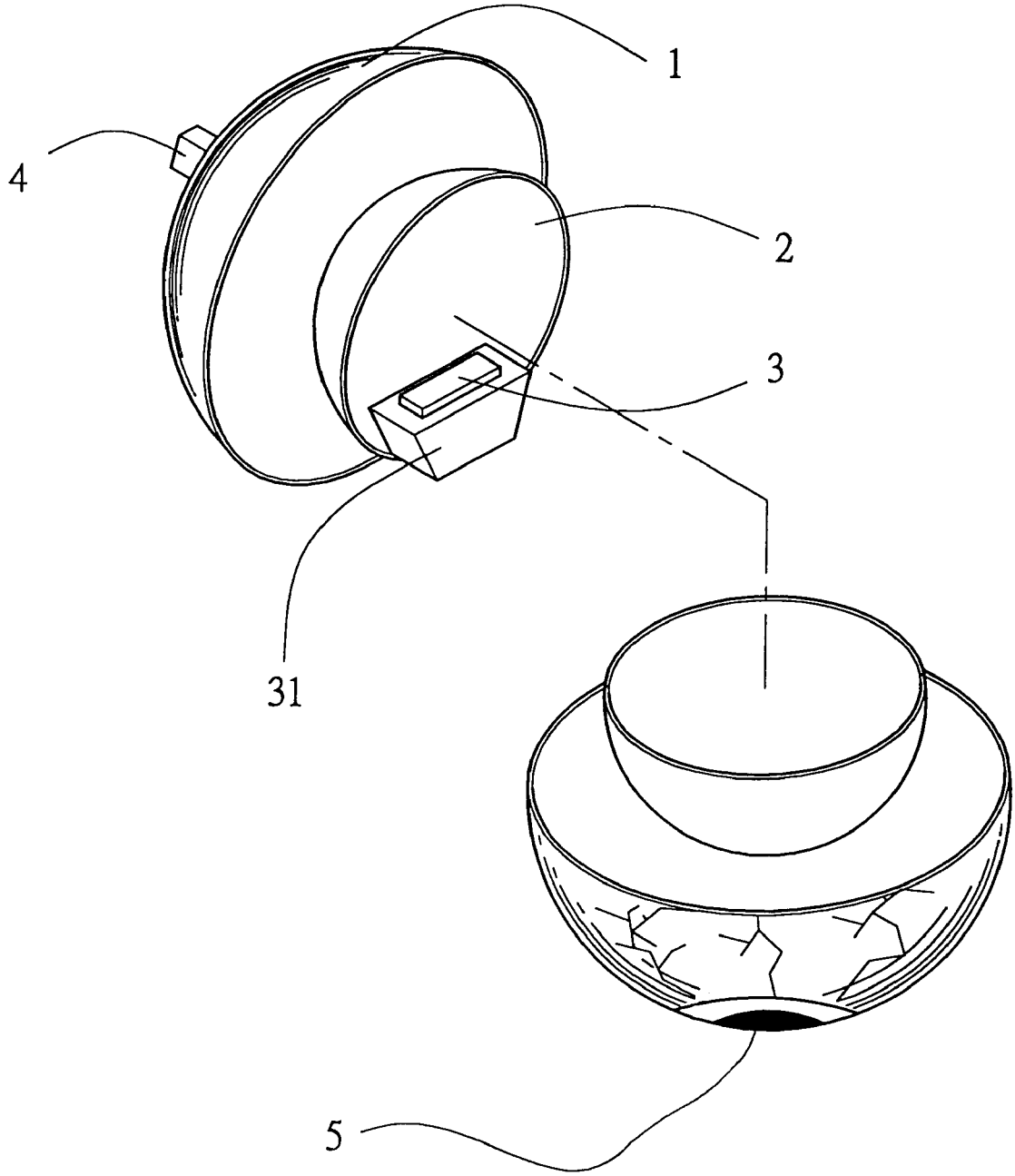
FIG. 1 is a fragmentary elevational view of an animated ornament constructed in accordance with the present invention.
Figure 2:
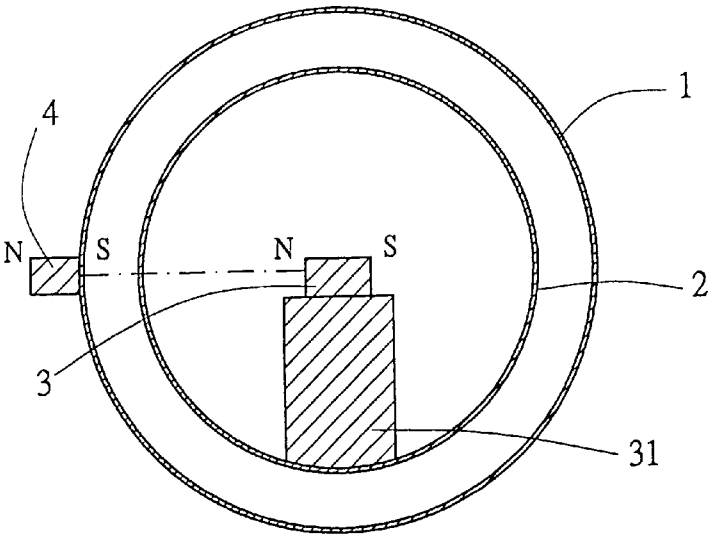
FIG. 2 is a sectional perspective view of the present invention.
Figure 5:
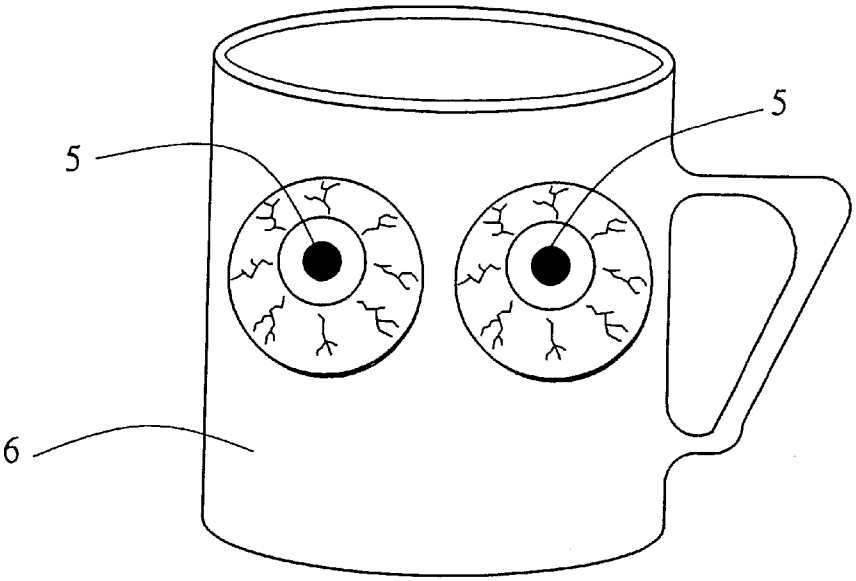
FIGS. 5–8 are other applications of an animated ornament constructed in accordance with the present invention.

Referring to FIG. 1 and FIG. 2, the present invention improves the conventional structure of an animated ornament, composed of a globular shell 1, a hollow ball 2, an inner magnet 3, an outer magnet 4, and a piece of non-magnetic, high-density material 31 (such as copper, tin, plastic etc.). The hollow ball 2, smaller than the globular shell 1, is included in the globular shell 1, and decorative FIG. 5 are drawn or attached to the hollow ball 2 (decorative FIG. 5 not shown in FIG. 1 and FIG. 2). The space in between the hollow ball 2 and the globular shell 1 is filled up with liquid so that the hollow ball 2 floats in the liquid, able to turn around in all directions. The non-magnetic, high-density material 31, such as plastic, copper, or tin, is attached to the lower part of the hollow ball 2, and the inner magnet 3 is fastened to the top of the non-magnetic material 31. The outer magnet 4 is fixed onto the surface of the globular shell 1, where the outer magnet 4 and the inner magnet 3 can line up in the same radius with the effect of magnetic force between them and thus make the decorative FIG. 5 always face towards a fixed direction (presumably towards the front of the ornament) when the ornament is set still.

Figure 3:
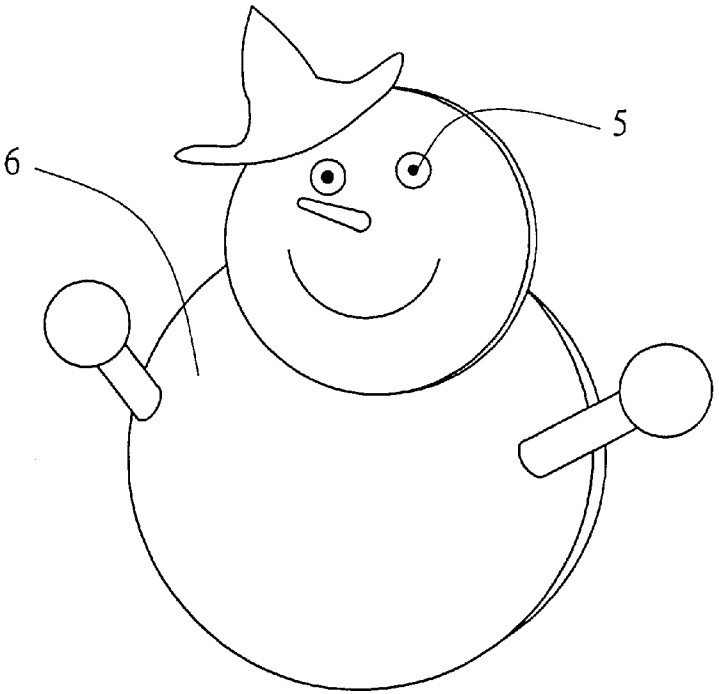
FIG. 3 is an application of the present invention.
Figure 4:
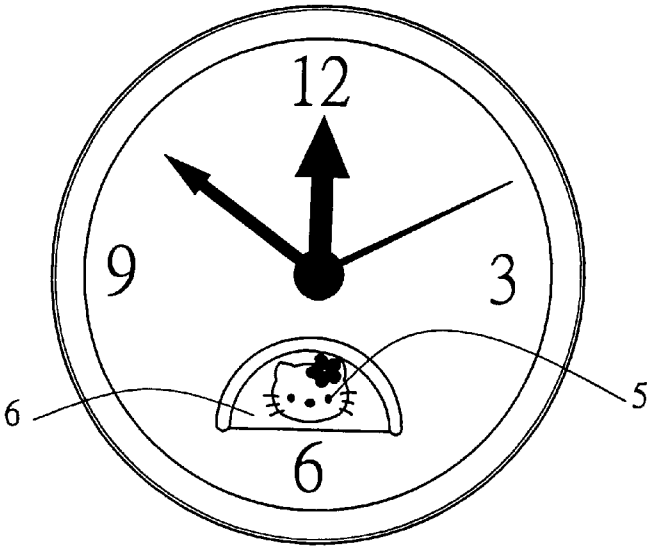
FIG. 4 is another application of the present invention.

Conventionally, decorative balls with the function of a compass are designed to make the FIG. 5 face upwards, whereas the structure of the present invention makes the decorative FIG. 5 face laterally (typically towards the front) whenever the ornament is set still. This innovative design of the present invention can be applied to a wide variety of decorations and toys 6 so that decorative figures can always turn to a desired direction. For instance, the decorative figures may be eyeballs 5 of a doll 6 (as shown in FIG. 3), a popular icon 5 attached to an alarm clock 6 (see FIG. 4). Moreover, the outer magnet 4 can be connected with the pendulum of a clock and thus moves back and forth along with the pendulum, where the outer magnet 4 does not have to be fixed to the surface of the globular shell. In this way, the decorative FIG. 5 on the hollow ball 2 would follow the periodical movement of the pendulum.

Figure 6:
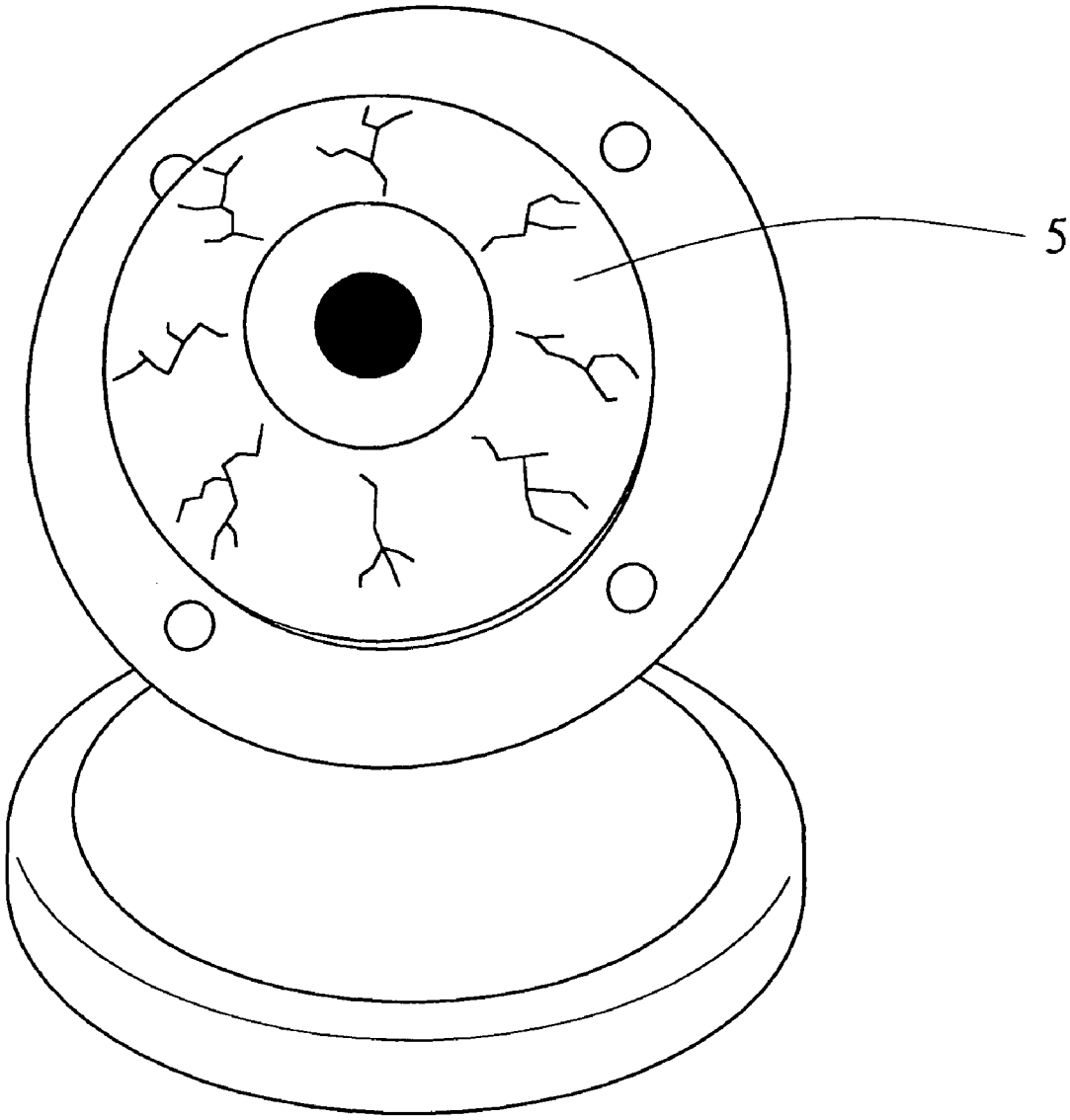
Figure 7:
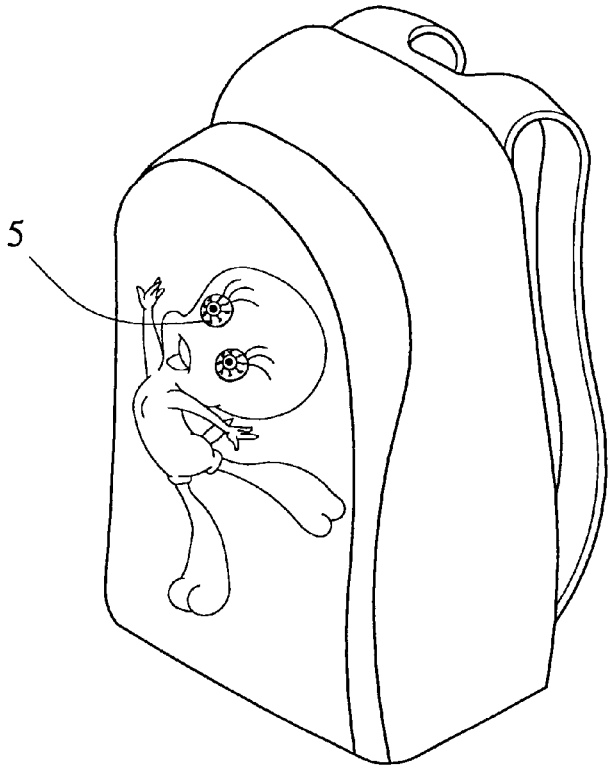
Figure 8:
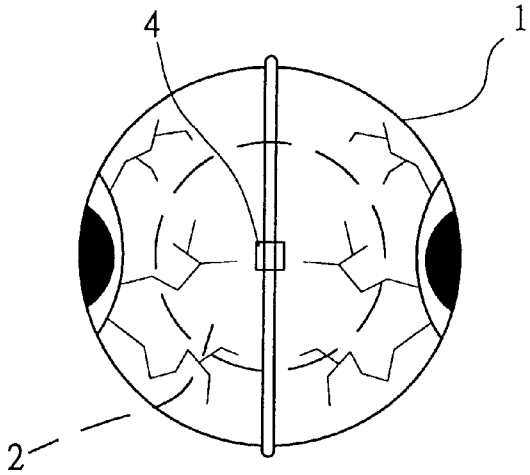

The present invention can also be applied to a mug 6 (see FIG. 5), where the decorative FIG. 5 moves around when users shake the mug 6. Other applications of the present invention can be seen on an ornamental globe (see FIG. 6), a backpack (see FIG. 7), and an ornament with decorative figures on both sides (see FIG. 8).

While only a few embodiments of the present invention has been shown and described, it will be understood that various modifications and changes could be made thereunto without departing from the spirit and scope of the invention disclosed.

What is claimed is:

1. An enhanced structure for an animated ornament comprising:

a globular shell having a front surface and a rear surface;

a hollow ball having a lower part and an upper part, said hollow ball being totally surrounded by said globular shell, said hollow ball and said globular shell forming a space there between, said space being filled up with liquid for floating said hollow ball in said globular shell, and said hollow ball capable of freely turning around in all directions while in said globular shell and surrounded by said liquid;

a piece of non-magnetic, high-density material having a bottom and a top, said bottom of said piece of non-magnetic, high-density material installed inside the lower part of said hollow ball and freely turning around in all directions with said hollow ball while in said globular shell and surrounded by said liquid;

at least one decorative figure connected to said piece of non-magnetic, high-density material and freely turning around in all directions with said hollow ball while in said globular shell and surrounded by said liquid;

an inner magnet fixed on the top of said piece of non-magnetic high-density material, said inner magnet having an inner magnetic force; and an outer magnet securely fastened to the rear surface of said globular shell, said outer magnet having an outer magnetic force with an effect of magnetic attraction for attracting said inner magnet, where said outer magnet uses said effect of magnetic attraction to attract said inner magnetic during said freely turning of said hollow ball to slow said hollow ball and line up said inner magnet in the same radius with the effect of magnetic attraction, so that said at least one decorative figure face towards the front surface of said globular shell when the ornament is set still.

2. The enhanced structure as recited in claim 1, wherein said piece of non-magnetic, high-density material can be selected from a group of copper, tin or plastic.

* * * * *